United States Patent [19]

Hoffman

[11] 4,295,346

[45] Oct. 20, 1981

[54] RECIRCULATING VAPOR SYSTEM FOR GELLING CRYOGENIC LIQUIDS

[75] Inventor: Lawrence C. Hoffman, Fair Oaks, Calif.

[73] Assignee: Aerojet-General Corporation, La Jolla, Calif.

[21] Appl. No.: 185,349

[22] Filed: Sep. 8, 1980

[51] Int. Cl.[3] ..... F25B 1/06

[52] U.S. Cl. ..... 62/500; 23/295 G; 44/7 D; 44/52; 48/196 FM; 62/48; 206/568; 252/70

[58] Field of Search ..... 62/1, 48, 500; 23/295 G; 44/7 D, 52; 48/196 FM; 206/568; 252/67, 70

[56] References Cited

U.S. PATENT DOCUMENTS

| | | | |
|---|---|---|---|
| 1,726,018 | 8/1929 | Farrar | 62/48 |
| 2,356,407 | 8/1944 | Hutchinson | 260/676 |
| 2,938,779 | 5/1960 | Kolfenbach et al. | 44/7 D |
| 3,132,096 | 5/1964 | Walton | 210/59 |
| 3,364,690 | 1/1968 | Torobin | 62/58 |
| 3,393,152 | 7/1968 | Smith et al. | 252/67 |
| 3,514,274 | 5/1970 | Cahn et al. | 48/190 |
| 3,634,050 | 1/1972 | Corino et al. | 44/7 D |
| 3,975,167 | 8/1976 | Nierman | 48/190 |
| 4,011,730 | 3/1977 | Rosenberg et al. | 62/1 |
| 4,190,016 | 2/1980 | Hendricks | 118/724 |

*Primary Examiner*—Ronald C. Capossela
*Attorney, Agent, or Firm*—John S. Bell

[57] ABSTRACT

A system for gelling cryogenic liquid in which a jet pump is used to educt cryogenic vapor from a gel storage container, mix that educted vapor with steam or other gelant vapor, and inject the resultant mixture into a fine spray of cryogenic droplets, is described herein.

3 Claims, 1 Drawing Figure

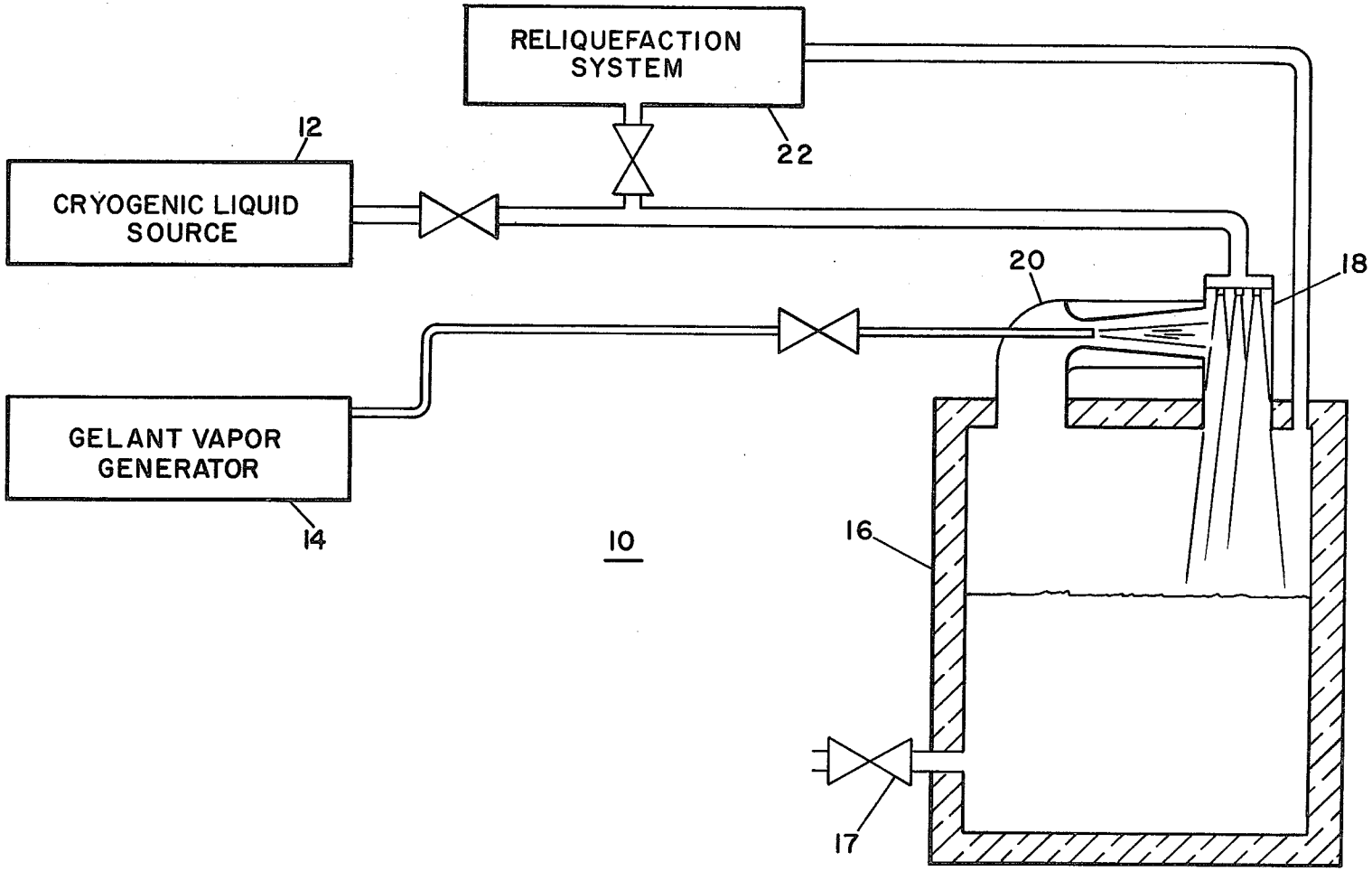
RELIQUEFACTION SYSTEM
22
CRYOGENIC LIQUID SOURCE
12
GELANT VAPOR GENERATOR
14
18
20
16
17
10

RECIRCULATING VAPOR SYSTEM FOR GELLING CRYOGENIC LIQUIDS

BACKGROUND AND SUMMARY

Cryogenic liquids can be gelled, or in other words converted to a jelly-like material formed by the coagulation of a colloidal particle-laden liquid, by forming a uniform dispersion of finely divided particles of a gelling agent or gelant in the cryogen. A gel can be produced, for example, by mixing steam or other gelant vapor with the cryogen in a manner that allows the cryogen to freeze the steam into an exceedingly fine dispersion of small ice particles. The formation of a gel can facilitate transportation and storage, reduce danger from spills in some situations, and limit absorption of gaseous and other impurities into liquids requiring purity such as liquid rocket propellants.

This invention provides an improved system for gelling cryogenic liquids. The system includes a spray column or other structure for providing a fine spray of crycgenic liquid droplets, a container or vessel for receiving that spray, and an eductive pump for mixing a gelling agent with vapor from the gel container and injecting the resultant mixture into the cryogenic spray. When a superheated gaseous phase flow of gelling agent is supplied to drive the eductive pump, the system provides much improved mixing and produces a high quality uniform gel having a highly dispersed distribution of extremely fine gelant particles. The system can receive a cryogenic liquid to be gelled at a temperature substantially below the saturation temperature of that liquid; this minimizes the gel vaporization or boil-off gas that must ultimately be reliquefied.

BRIEF DESCRIPTION OF THE DRAWING

The FIGURE is a schematic block level illustration of a system for gelling cryogenic liquid.

DETAILED DESCRIPTION

The FIGURE shows a system 10 for gelling cryogenic liquid that includes a source 12 of cryogenic liquid and source 14 of a suitable agent for gelling the cryogenic liquid. For description of a specific embodiment, source 12 comprises a facility for liquefying natural gas, and source 14 comprises a steam generator. The system 10 also includes an insulated vessel 16 for gel storage prior to distribution through line 17, a spray column 18 for receiving liquid from source 21 and providing a fine droplet spray of that liquid to vessel 16, and an eductive jet pump 20 for injecting a mixture of a gelling agent or gelant and vapor carrier into the spray column 18. A relinquefaction system 22 is disposed to receive vapor or boil-off from the vessel 16 and reconvert that vapor back to a cryogenic liquid.

Liquid source 12, steam generator 14, and reliquefaction apparatus 22 are well known and not modified for this invention. Diverse geometry jet pumps, or devices in which a flow of one fluid entrains another, are available and suitable for use in the system 10. Pump 20 is a ventrui type jet pump as that configuration provides a high carrier to gelant entrainment ratio. A large volume flow of carrier gas or vapor enhances mixing and distribution of gelant particles into a cryogenic liquid, and provides an improved gel. Spray column 18 is constructed to provide a spray or mist of droplets as small as practical, and is of sufficient length so that gelant particles will be completely mixed into the spray before it strikes the liquid level in container 16. High quality industrial type spray nozzles provide 1 mil (0.25 mm) diameter or smaller size droplets, and that is sufficient.

In operation, the gelling apparatus of this invention can receive cryogenic liquid at substantially any temperature. A typical liquefaction source 12 will provide liquefied natural gas (LNG) to spray column 18 at about 190° R. Generator 14 provides steam to jet pump 20 that is superheated to about 760° R., the minimum temperature at which steam is completely dry. This minimizes the heat that must be removed to freeze the steam into ice particles, improves dispersion of the gelling agent in the cryogenic carrier vapor, and causes the gelant vapor to be frozen into small size particles than if for example the gelant is received as an atomized liquid. Steam flow from generator 14 drives the eductor pump 20 and causes cryogenic vapor from vessel 16 to recirculate through the pump and spray column. That is, the steam gelant jet entrains cryogenic vapor from the ullage of the tank 16.

Steam diffuses to a miniscule partial pressure in pump 20, becomes highly dispersed in the cryogenic vapor and freezes into sub-colloidal 5 to 200 mu mean diameter size nucleii in only about 1 microsecond. This mixture or ice particle laden vapor following mixing and momentum exchange, has a lower velocity than the primary steam jet to that pump, but the mass flow is greatly increased by the entrainment of the secondary fluid. Flow from pump 20 is injected into spray column 18 and mmixes well with the droplet spray of LNG from source 12 in the confined or limited volume of that column. The ice nucleii or particles are stripped from the gaseous or vapor flow, and attach to the comparatively large surface area of cryogenic liquid droplets in column 18 in about a milllisecond. The cryogenic droplets deposit in vessel 16 as a gel.

One advantage of this invention is that substantially any quantity of carrier gas that might be desired can be provided without introducing a burden or special factor not otherwise part of the system. Substantially more cryogenic vapor is formed in vessel 16 than is needed as a carrier gas, by absorption of heat from the gelant vapor embodiment. The cryogenic vapor forms at a pressure such that it flows readily out of the container 16. The cryogenic vapor flow through jet pump 20 is at a temperature of about 200° R.

What is claimed is:

1. A system for gelling cryogenic liquid comprising:

means for providing a spray of cryogenic liquid droplets;

a vessel for receiving said cryogenic spray;

a jet pump for introducing a gelant into said cryogenic spray disposed to also educt cryogenic vapor from said vessel; and, means for providing a flow of gelant fluid to said jet pump to thereby drive said pump.

2. The system of claim 1 in which:

said means for providing a cryogenic spray comprise a spray column for providing a spray of droplets having mean diameters no larger than about one mil; and said means for providing gelant fluid to said jet pump comprise means for providing a gaseous phase flow of a gelling agent to said pump.

3. The system of claim 2 in which:

said jet pump is disposed to introduce a mixture of cryogenic vapor and frozen gelant particles into said spray column; and said spray column is of sufficient length to provide gelant particles received from said jet pump with a stay time in said spray of cryogenic droplets of a leat one millisecond.

* * * * *